US012601361B2

(12) United States Patent
Sun et al.

(10) Patent No.: US 12,601,361 B2
(45) Date of Patent: Apr. 14, 2026

(54) FAN IMPELLER STRUCTURE

(71) Applicant: ASIA VITAL COMPONENTS CO., LTD., New Taipei City (TW)

(72) Inventors: Sung-Wei Sun, New Taipei City (TW); Chu-Hsien Chou, New Taipei City (TW); Yi-Chih Lin, New Taipei City (TW); Pei-Chuan Lee, New Taipei City (TW)

(73) Assignee: ASIA VITAL COMPONENTS CO., LTD., New Taipei City (TW)

( * ) Notice: Subject to any disclaimer, the term of this patent is extended or adjusted under 35 U.S.C. 154(b) by 0 days.

(21) Appl. No.: 18/430,341

(22) Filed: Feb. 1, 2024

(65) Prior Publication Data

US 2025/0237229 A1 Jul. 24, 2025

(30) Foreign Application Priority Data

Jan. 19, 2024 (TW) ..... 113102290

(51) Int. Cl.
*F04D 29/32* (2006.01)
*F04D 19/00* (2006.01)
*F04D 29/38* (2006.01)

(52) U.S. Cl.
CPC ..... *F04D 29/325* (2013.01); *F04D 19/002* (2013.01); *F04D 29/384* (2013.01)

(58) Field of Classification Search
CPC ..... F04D 29/384
See application file for complete search history.

(56) References Cited

U.S. PATENT DOCUMENTS 1,446,011 A * 2/1923 Jackson ..... B63H 1/28 416/236 R
3,174,681 A * 3/1965 Monroe ..... F04D 29/384 62/426
4,222,710 A * 9/1980 Katagiri ..... F04D 29/38 165/122

(Continued)

FOREIGN PATENT DOCUMENTS

CN 115182896 A 10/2022
TW 202323679 A 6/2023
TW M654659 U 4/2024

OTHER PUBLICATIONS

Search Report dated Nov. 27, 2024 issued by Taiwan Intellectual Property Office for counterpart application No. 113102290.

*Primary Examiner* — Michael L Sehn
(74) *Attorney, Agent, or Firm* — Demian K. Jackson; Jackson IPG PLLC

(57) ABSTRACT

A fan impeller structure includes a hub having a top and a sidewall; and a plurality of blades being circumferentially spaced on the sidewall. Each of the blades has a barrier zone formed at a tip portion of the blade; the barrier zone is used to prevent or block fluid at a lower side of the blade to turn over to an upper side of the blade owing to a difference in the pressure distributed over the upper and the lower side of the blade. Therefore, when a fan using the fan impeller structure is operating, the fan is able to maintain constant air flow and static efficiency to largely reduce vortices formed at the tip portions of the blades (also referred to as wingtip vortices) and accordingly, to reduce the occurrence of aerodynamic noise.

7 Claims, 2 Drawing Sheets

(56) References Cited

U.S. PATENT DOCUMENTS

| | | | | | |
|---|---|---|---|---|---|
| 5,226,783 | A * | 7/1993 | Mita | F04D 29/384 | 416/223 R |
| 5,813,837 | A * | 9/1998 | Yamamoto | B01F 27/113 | 416/223 R |
| 6,164,919 | A * | 12/2000 | Vanmoor | B64C 11/16 | 416/243 |
| 8,512,004 | B2 * | 8/2013 | Nakagawa | F04D 29/384 | 415/173.1 |
| 10,605,269 | B2 * | 3/2020 | Stadler | F04D 29/164 | |
| 2019/0301471 | A1 * | 10/2019 | Wang | F04D 29/164 | |

* cited by examiner

FAN IMPELLER STRUCTURE

This application claims the priority benefit of Taiwan patent application number 113102290 filed on Jan. 19, 2024, the entirety of which is incorporated by reference.

FIELD OF THE INVENTION

The present invention relates to the field of cooling fan, and more particularly, to a fan impeller structure that enables a fan using it to maintain constant air flow and static efficiency during operating and reduces the occurrence of aerodynamic noise.

BACKGROUND OF THE INVENTION

Following the constant progress in the scientific and technological fields, people rely more and more on various kinds of electronic devices. Electronic elements in an operating electronic device, such as a computer, a notebook computer, a server, etc., would produce a large amount of heat. The operating electronic device tends to become overheated if the produced heat is not removed from the device in time. Therefore, in addition to passive coolers, most of the electronic products available in the market would further use an active heat removing device, such as a fan, to dissipate the heat produced by the electronic elements into air outside the electronic products, so that the electronic products in operating can maintain at a specific range of working temperature.

In a conventional axial fan, pressure distributed over the upper surface and the lower surface of a tip portion of the fan blade is different. The lower surface of the tip portion of the fan blade has a higher pressure relative to the pressure at the upper surface of the tip portion of the fan blade. As a result, airflow at the lower surface of the tip portion having a higher pressure turns over to the upper surface of the tip portion having a relatively lower pressure. This would produce strong tip vortices at the tip portions of the fan blades, and the tip vortices would cause an unsteady flow field and accordingly, produce very loud noise.

It is therefore tried by people skilled in the art to develop a fan impeller structure that enables a fan in operation to maintain constant air flow and static efficiency to thereby reduce vortices formed at the tip portions of the fan blades and reduce the noise produced during fan operation.

SUMMARY OF THE INVENTION

To effectively overcome the above problem, it is a primary object of the present invention to provide a fan impeller structure that enables a fan using it to maintain constant air flow and static efficiency during operating, so that noise produced when the fan operates can be largely reduced.

Another object of the present invention is to provide a fan impeller structure that enables a fan using it to largely reduce vortices formed at tip portions of the blades of the fan.

To achieve the above and other objects, the fan impeller structure includes a hub and a plurality of blades. The hub has a top and a sidewall; and the blades are circumferentially spaced on the sidewall. Each of the blades has a barrier zone formed at the tip portion of the blade, and the barrier zone is formed by at least one of a lifted section and a declined section.

With the fan impeller structure of the present invention having the above-described structural design, when a fan using the present invention is operating, the barrier zones on the blades serve to prevent fluid at a lower side of the blades from turning over to an upper side of the blades owing to a difference in the pressure distributed over the lower and the upper side of the blade. Therefore, the fan can maintain constant air flow and static efficiency to largely reduce the vortices at the tip portions of the blades (also referred to as the wingtip vortices) and to reduce aerodynamic noise produced when the fan operates.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
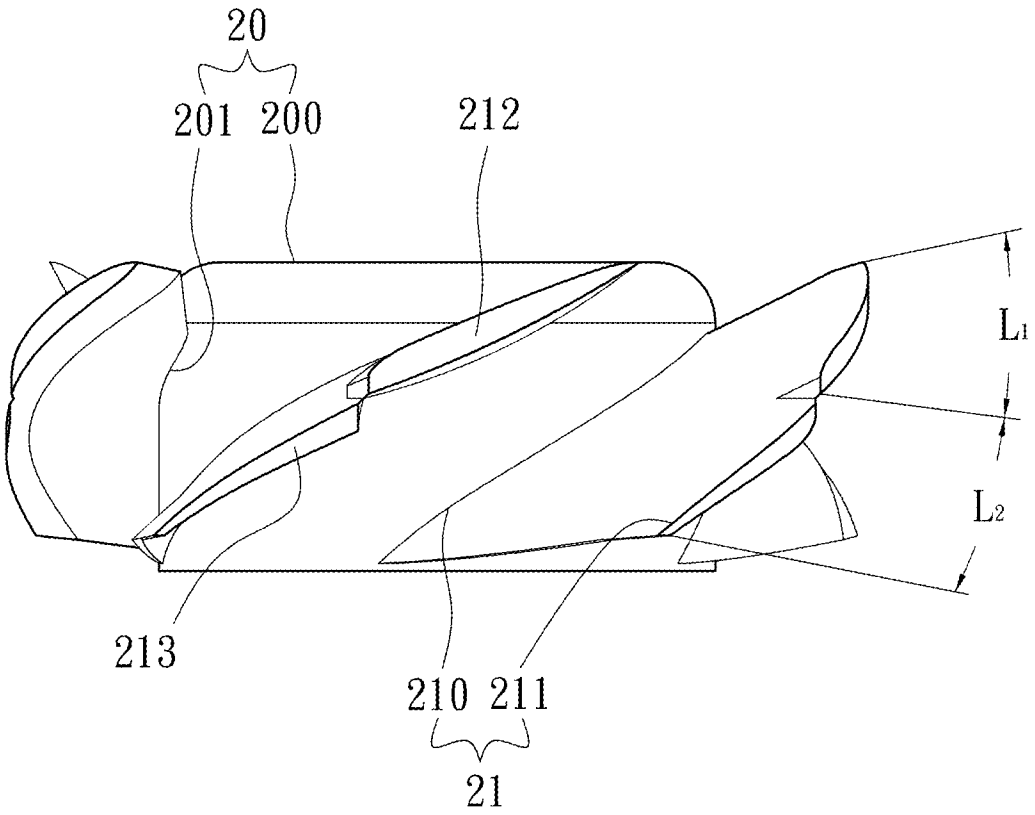
FIG. 1 is a perspective side view of a fan impeller structure according to a first embodiment of the present invention.

The present invention will now be described with some preferred embodiments thereof. For the purpose of easy to understand, elements that are the same in the preferred embodiments are denoted by the same reference numerals.

Figure 2:
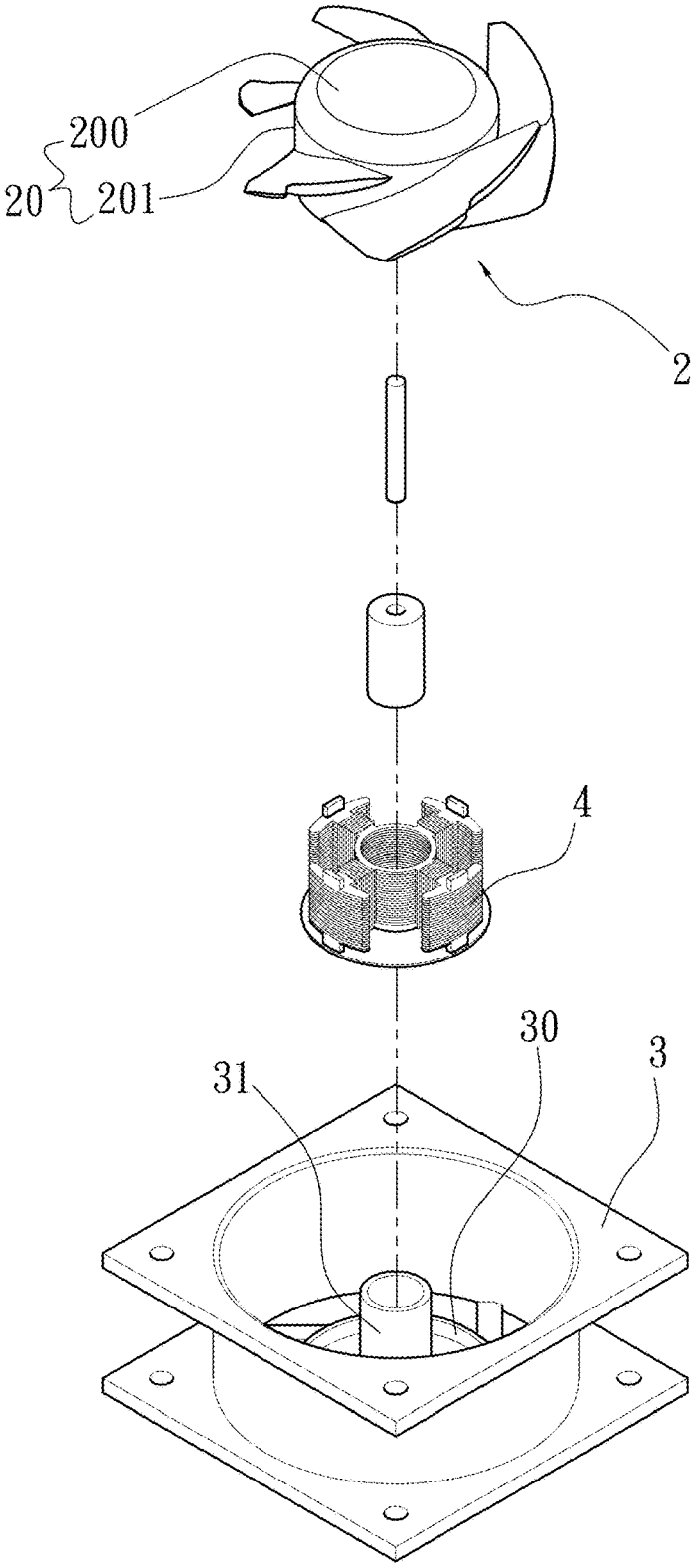
FIG. 2 is an exploded perspective view showing the fan impeller structure according to the first embodiment of the present invention is assembled to a fan frame and a stator.

Please refer to FIGS. 1 and 2, which show the fan impeller structure 2 according to a first embodiment of the present invention in different angles. As shown, the fan impeller structure 2 includes a hub 20 and a plurality of blades 21. The hub 20 has a top 200 and a sidewall 201. The sidewall 201 is extended downward from an outer periphery of the top 200. The blades 21 are circumferentially spaced on the sidewall 201. Each of the blades 21 has a root portion 210 and a tip portion 211, which are located at two radially opposing ends of the blade 21 with the root portion 210 being connected to the sidewall 201. The tip portion 211 of the blade 21, i.e. the radially outer end of the blade 21 forms a barrier zone, which may include at least one of a lifted section 212 and a declined section 213. The lifted section 212 may be located adjacent to the declined section 213. The lifted section 212 is formed by upward bending, folding or protruding a length of the tip portion 211 to serve as a shielding barrier, while the declined section 213 is formed by turning or folding a length of the tip portion 211 downward to serve as a stopper.

It is noted the barrier zone is designed according to a user's requirement to include cooperating lifted section 212 and declined section 213 without the need of particularly limiting the positions at where the lifted section 212 and the declined section 213 are formed on the tip portion 211. Further, according to the user's requirement, it is also possible for the entire tip portion 211 of each blade 21 to form a lifted section 212 or a declined section 213.

In the case each of the barrier zones is formed by both of the lifted section 212 and the declined section 213, a first width L1 and a second width L2 extended laterally are defined on the tip portion 211 of each blade 21. The lifted section 212 is located corresponding to the first width L1 and the declined section 213 is located corresponding to the second width L2. In the first embodiment of the present invention, the first width L1 is equal to the second width L2, so that the lifted section 212 and the declined section 213 are the same in width. In a fan impeller structure 2 according to a second embodiment of the present invention, the first width L1 is smaller than the second width L2, so that the lifted section 212 has a width shorter than that of the declined section 213. Of course, in other embodiments of the present invention, the first width L1 can be larger than the second width L2, so that the lifted section 212 has a width longer than that of the declined section 213 (not shown). In other words, in the present invention, the widths of the lifted section 212 and declined section 213 formed on the tip portion 211 of the blade 21 are adjustable according to the user's requirement.

Further, in the present invention, the barrier zones (i.e. the lifted sections 212 and the declined sections 213) can be made of a material the same as or different from that of the blades 21. The material for forming the blades 21 and the barrier zones may be a macromolecular material, a metal material, or a composite material. The lifted section 212 and the declined section 213 at the tip portion 211 of the blade 21 can be integrally formed with the blade 21. Alternatively, the barrier zone (i.e. the lifted section 212 and the declined section 213) at the tip portion 211 of the blade 21 can be a separate and independent component being connected to the blade 21 by way of riveting, snapping, bonding, locking, welding, or fusion welding. That is, the blade 21 and the barrier zone thereof may be non-integrally formed with each other but achieve the same functions as those can be achieved by the integrally formed blade 21 and barrier zone.

Further, the lifted section 212 and the declined section 213 at the tip portion 211 of the blade 21 are extended continuously at the tip portion 211 of the blade 21. Alternatively, as in a fan impeller structure according to a third embodiment of the present invention, the lifted section 212 and the declined section 213 are extended discontinuously at the tip portion 211 of the blade 21. That is, a gap may be provided between the lifted section 212 and the declined section 213. In other words, the lifted section 212 and the declined section 213 formed at the tip portion 211 of the blade 21 may be selectively configured to extend continuously or discontinuously on the blade 21 according to the user's requirement while both configurations can similarly achieve the intended functions of the present invention.

Please refer to FIG. 2. As shown, the fan impeller structure 2 of the present invention is mounted to a fan frame 3. One side of the fan frame 3 has a base 30 provided thereat, and a shaft sleeve 31 is extended upward from the base 30. A stator assembly 4 is correspondingly fitted on around an outer side of the shaft sleeve 31 and the above-described fan impeller structure 2 is correspondingly fitted on around an outer side of the stator assembly 4. Since the above connection structure is well known in the prior art, it is not repeatedly described in detail herein.

When a fan using the fan impeller structure 2 of the present invention is operating and maintains constant airflow and constant static efficiency all the time, the blades 21 of the fan impeller structure 2 of the fan having the barrier zones provided thereon can have reduced vortices formed at the tip portions 211 (also referred to as the wingtip vortices) of the blades 21 to therefore enable largely reduced aerodynamic noise. This is because the lifted sections 212 serve as shielding barriers to prevent fluid at a lower side of the blades 21 from turning over to an upper side of the blades 21 owing to a difference in the pressure distributed over the upper and the lower side of the tip portions 211 of the blades 21; and the declined sections 213 serve to block or restrict the fluid at the lower side of the blades 21 from turning over to the upper side of the tip portions 211 of the blades 21 owing to the difference in the pressure distributed over the upper and the lower side of the tip portions 211 of the blades 21.

In conclusion, the present invention has the following advantages, compared to the prior art:

1. The fan impeller structure of the present invention can largely reduce the noise produced by the fan in operating;
2. The fan impeller structure of the present invention can largely reduce the tip vortices when the fan is operating; and
3. The fan impeller structure of the present invention enables the fan to maintain constant airflow and static efficiency without reducing the air flow.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A fan impeller structure comprising:

a hub having a top and a sidewall and a plurality of blades circumferentially spaced on the sidewall; each of the blades having a root portion at a radially inner end of the blade, the root portion connected to the sidewall and a tip portion at an opposite, radially outer end of the blade, the tip portion forming a barrier zone at a radially outermost edge of the blade, the barrier zone including one continuously inclining lifted section having a first width and one continuously declining declined section having a second width, and wherein the lifted section is discontinuous from the declined section, the root portion having a geometry different from the continuously inclining lifted section having the first width and different from the continuously declining declined section having the second width of the barrier zone and the root portion having a curvature describing a non-linear structure, such that the barrier zone prevents fluid at a lower side of the blade from turning over to an upper side of the blade owing to a difference in the pressure distributed over the upper and the lower side of the tip portion of the blade to thereby enable reduced vortices at the tip portions of the blades and reduced aerodynamic noise.

2. The fan impeller structure as claimed in claim 1, wherein the first width equal to the second width.

3. The fan impeller structure as claimed in claim 1, wherein the lifted sections and the declined sections are integrally formed with the respective blades.

4. The fan impeller structure as claimed in claim 1, wherein the lifted sections and the declined sections are separate and independent components and are connected to the respective blades by a way selected from the group consisting of riveting, snapping, bonding, locking, welding, and fusion welding.

5. The fan impeller structure as claimed in claim 1, wherein the lifted sections and the declined sections are made of a material the same as that of the blades.

6. The fan impeller structure as claimed in claim 5, wherein the lifted sections and the declined sections are made of a macromolecular material.

7. The fan impeller structure as claimed in claim 1, wherein the fan impeller structure is mounted to a fan frame, which has a base provided at one side thereof and a shaft sleeve extended upward from the base; and an outer side of the shaft sleeve having a stator assembly fitted thereon and the hub being correspondingly fitted on around an outer side of the stator assembly.

* * * * *